United States Patent [19]

Spraggins

[11] Patent Number: 4,820,229

[45] Date of Patent: Apr. 11, 1989

[54] AMUSEMENT DEVICE

[76] Inventor: Gary L. Spraggins, 1928 E. Colgate Dr., Tempe, Ariz. 85283

[21] Appl. No.: 15,439

[22] Filed: Feb. 17, 1987

[51] Int. Cl.[4] ..... A63H 5/00; A63H 33/26

[52] U.S. Cl. ..... 446/26; 446/405; 446/485

[58] Field of Search ..... 446/26, 27, 397, 405, 446/485, 219; 362/806, 811; 340/815.15, 384 E

[56] References Cited

U.S. PATENT DOCUMENTS 4,321,768 3/1982 Engelhardt ..... 446/397 X 4,635,516 1/1987 Giannini ..... 446/26 X

*Primary Examiner*—Mickey Yu

*Attorney, Agent, or Firm*—Richard R. Mybeck

[57] ABSTRACT

The present invention relates to an amusement device to simulate laser and phasor sights and sounds in Star Wars-like play situation. The device, shaped like a guantlet for circumscription about the user's arm allows a variety of collimated light rays accompanied by appropriate sounds to be selectively transmitted toward the "enemy" by the activation of one or more switches precoordinated with the desired sight/sound simulated mode of "destruction". The rays are emitted in a plane parallel to the user's hand to permit reasonably precise aiming.

13 Claims, 1 Drawing Sheet

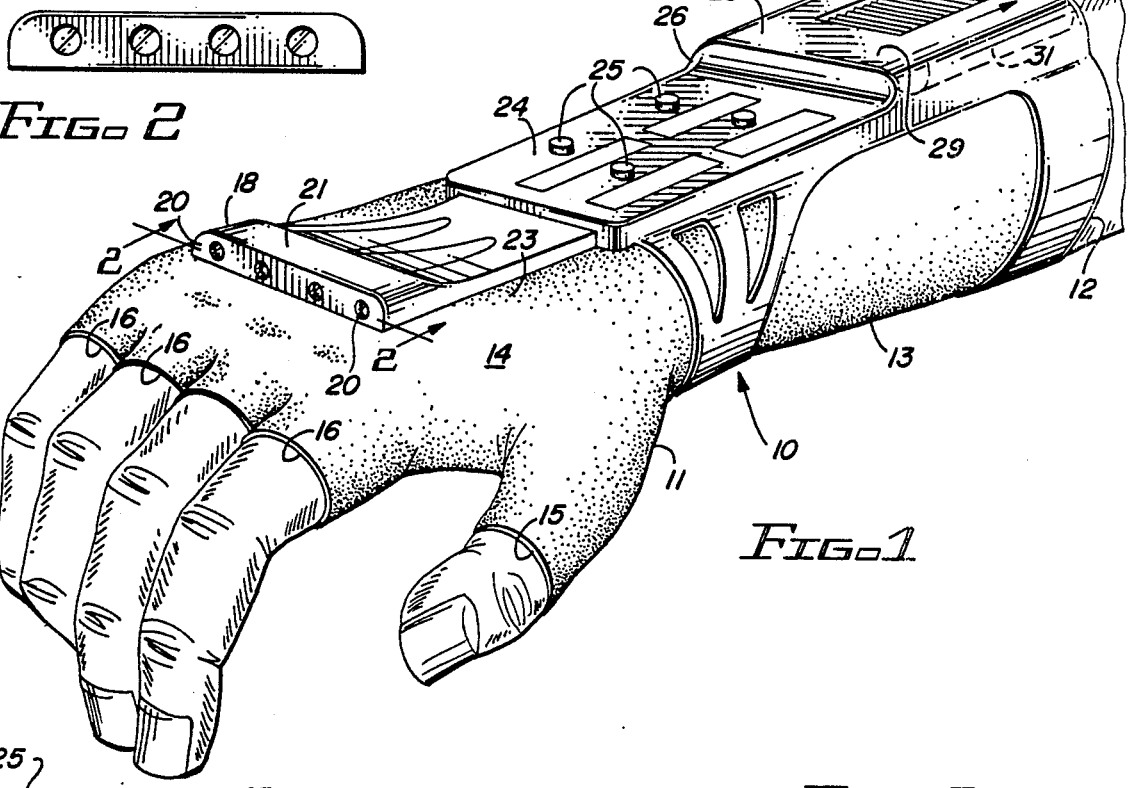
FIG. 2
FIG. 1
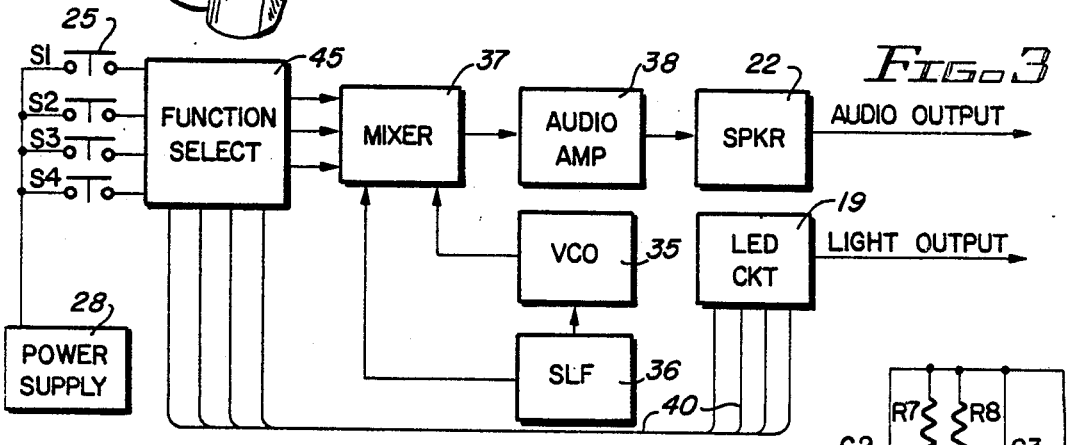
FIG. 3
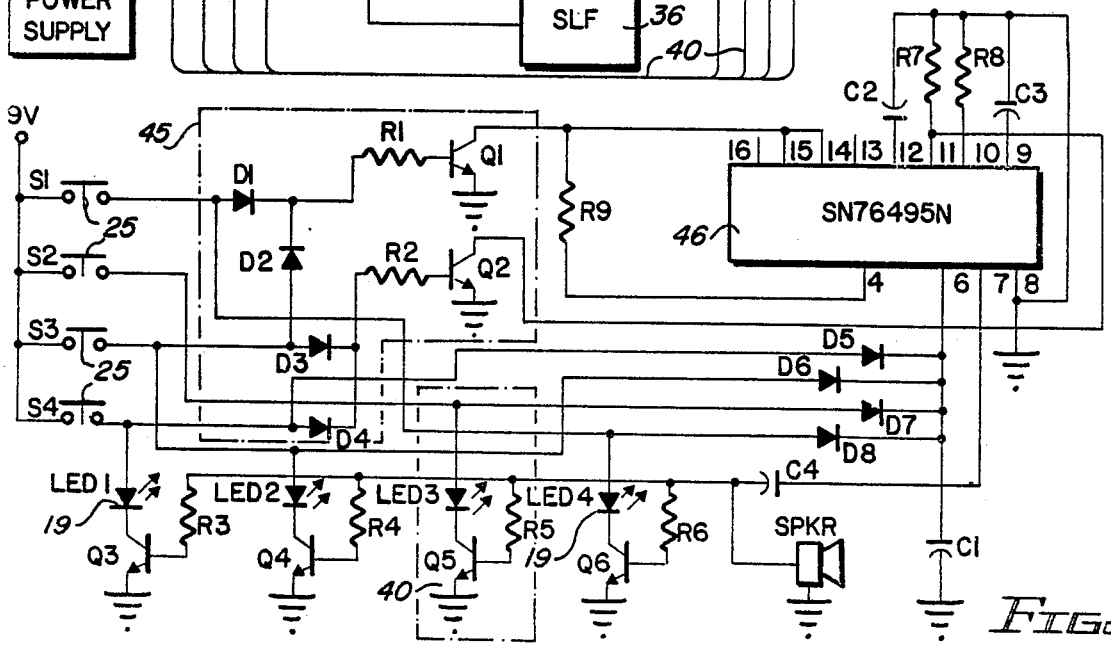
FIG. 4

AMUSEMENT DEVICE

INTRODUCTION

The present invention relates to a device to stimulate the user's imagination and more particularly to a novel imagination stimulation device which produces both light and sound and creates a combination of collimated light and preselected sound effects which stimulate the user to imagine himself in a myriad of fantastic locations and situations.

BACKGROUND OF THE INVENTION

Lighting and sound effects have been used as adjuncts to recreational activity for many years. Hand held flashlights have been used to play light tag. Noise makers have also been used while engaged in play for the purposes of special effects. Both noise and light producing devices have also been used for expressing pleasure and displeasure and run the range from the most intimate discotheque and to the latest video game. However man's insatiable hunger for new and exciting sensory experiences has generated a never-ending search for new devices that can produce new combinations of light and sound effects in a variety of settings for recreational purposes. While a variety of devices have been suggested by the prior art, none have heretofore possessed the unique combination of features which enable the present invention to be truly different.

To illustrate the variety of the prior art devices which predate the present disclosure, Reiner et al (U.S. Pat. No. 3,949,517) and Reiner et al (U.S. Pat. No. 3,953,935) each disclosed a power supply battery pack for electrically activated toys which power pack and the contacts therefrom may be embedded in a glove or mitten or wand. Other prior devices which embody light and/or sound generators in wearing apparrel include Bonnano (U.S. Pat. No. 3,309,691), who teaches a signaling device mounted in a helmet which may include a battery operated lamp and buzzer, and Schwartz (U.S. Pat. No. 2,805,326), who teaches a wrist supported flash light which, when activated can emit a ray of light of intentionally variable color for signaling purposes.

None of the prior devices however, obtain the unique interaction of sound and light obtained by the present invention to enable an imaginative youngster to amuse himself and friends for extended periods in Star Wars or like galactic games.

BRIEF SUMMARY OF THE INVENTION

The present invention comprises an imagination stimulating device in the form of a phasor gun embodied in a gauntlet-style glove. Each device contains multicolored light sources and interactive electronic circuits to selectively simulate laser beams and phasor sounds. Control switches and the electronic circuits are housed on the wrist and connected by wires to the light sources which are secured to the back of the hand just above knuckles. A power source is suitably mounted adjacent the switches or, if desired, can be disposed in a pouch adjacent the interior of the mouth of the glove. Four phasor functions, each with its own phasor sound and simulated laser beam, are provided.

Accordingly, it is a principal purpose of the present invention to provide a novel and unique imagination stimulating device which simulates the sights and sounds of lasers and phasors to enhance the impact of intergalactic fantasies.

Another object of the present invention is to provide a novel device for enhancing a child's imagination and augmenting the realism of Star Wars-like play.

A further object of the present invention is to provide a self-contained device capable of emulating both laser sight and phasor sounds in response to each of a different effect selected by the user thereof in simulated play.

These and still further objects as shall herinafter appear are readily fulfilled by the present invention in a remarkably unexpected manner as will be readily discerned from the following detailed description of an exemplary embodiment thereof.

BRIEF DESCRIPTION OF THE DRAWING

FIG. 1 is an isometric view of a device for the right hand embodying the present invention;

FIG. 2 is a cross-section taken along line 2—2 of FIG. 1;

FIG. 3 is a schematic diagram of the present invention; and

FIG. 4 is a circuit diagram for use in the practice of the present invention.

DESCRIPTION OF THE PREFERRED EMBODIMENT

Referring to FIGS. 1 and 2, a device embodying the present invention is indicated by the general reference 10 and comprises a body member 11 shaped as a gauntlet or the like and having mouth 12 at the upper end thereof to facilitate access to an arm surrounding portion 13 and hand surrounding portion 14 so that when the user's arm and hand are inserted therewithin, the user's thumb will extend through thumb opening 15 and the user's fingers will extend through finger openings 16 to facilitate digit mobility.

Effects emitting means 18 is attached to the back of hand surrounding portion 14 and disposed on the back of the user's hand between the wrist and the proximal phalanges. Effects emitting means 18 as will be hereinafter described in detail, comprises a light source 19, light collimating means 20, a housing 21, and sound producing means 22.

Housing 21 is fixedly attached to hand surrounding portion 14 so that the collimated light beams selectively emitted from light source 19 through collimating means 20 are not obstructed by any portion of device 10. In one practice of the present invention, housing 21 will be positioned so that the beams produced thereby would travel in a plane that is essentially parallel or tangential to the planar surface 23 of hand surrounding portion 14 upon which effect emitting means 18 is secured.

A control assembly 24 (hereinafter described in detail) is secured to arm surrounding portion 13 adjacent the user's wrist so that the use of the device 10 is rendered ergometrically efficient. Control assembly 24 consists of switching means 25 enclosed within a housing 26. The electrical wiring to interconnect light source 19, sound producing means 22 and a power supply assembly 28 are selectively activated and deactivated by control assembly 24 as will be herinafter described in detail in connection with FIGS. 3 and 4.

Power supply assembly 28 consists of housing 29 mounted upon arm surrounding portion 13 or, if desired, may consist of a pouch (not shown) formed on the inner surface of arm surrounding portion 13. Either way, the housing or pouch 29 will contain a suitable dry cell battery 31 therewith. The so-called "alkaline" batteries (9V) are found to work well with the device.

Suitable electical circuitry for device 10 is diagrammed in FIG. 3 and comprises a voltage controlled oscillator 35, a super-flow frequency oscillator 36, a mixer 37, and an audio amplifier 38. The circuitry further comprises both high output LED circuits and function selection circuits as will appear from the following description.

In one practice of the present invention, highly desirable results are obtained when voltage control oscillator 35 is a squarewave oscillator designed to have its bandwidth within the range of human hearing, (preferably somewhere between 400 and 4000 Hz). The oscillator's frequency is determined by the voltage applied to the oscillator's input. The control is of inverse proportion, that is, the higher the voltage applied to the input the lower the output frequency of the osillator, the lower the voltage applied to the input the higher the frequency.

By using alternating or changing voltages applied to the input of the oscillator, its output frequency can be made to go higher and lower according to the input voltage as described earlier (the lower the input voltage the higher the output frequency and vice versa). Thus, when a changing voltage is applied to the input whch increases gradually and is then immediately but gradually decreased and this cycle is repeated, a sinusoidal signal is created because a changing voltage causes the frequency of voltage control oscillator 35 to increase and decrease in a warbling fashion thereby creating a phasor gun sound.

The super-low frequency oscillator 36 is designed to opeate in the range from 0.1 to 30 Hz or cycles per second and produces two types of voltage signals, namely, a 50% dutycycle squarewave, or a triangular wave. The output of oscillator 36 is not used to stimulate sound but only to control or mix with the sounds created by oscillator 35.

Mixer 37 consists of logic select inputs and a modulator. The logic selects one or a combination of the inputs from the signal generator circuits and performs a logical AND of the selected inputs. The output from mixer 37 is not a combination of simultaneous sounds but rather a modulation of one of the selected inputs by another selected input. Thus, a warbling tone from the voltage controlled oscillator 35, when ANDed with a 50% duty cycle squarewave from the super-low frequency oscillator 36, creates a pulsing sound.

The audio amplifier 38 receives input and creates the mixer output which is used to drive the output speaker and simultaneously drive the selected LED circuits (described below) on and off in unison with the sound.

Each LED circuit 40, and as will appear there is a separate circuit for each effect, consists of a light emitting source such as a special high output light emitting diode 19 (LED) and connects in series with transistor function switch 25. When on of the function switches 25 is pressed, the circuit 40 associated therewith is activated. A portion of the output through the audio amp 38 is fed to the LED circuit 40 activating it and causing the LED 19 to flash or waver with the sound. A lens or collimating means 20 is mounted in front of the LED 19 to keep the light collimated and create a more realistic laser beam effect.

Each effect or function also contains a function selection circuit 45 which is necessary to choose what inputs are seen by the mixer. Each circuit 45 contains a diode (designated D1, D2, D3 and D4) and allows selected inputs to pass into the mixer while blocking others. When one of the switches 25 is depressed, circuit 45 activates the desired mixer input. The activation of one or more of the switches 25 also applies power to the integrated circuit chip 46 and LED driver circuits 40 as shown in FIG. 4. Note that when chip 46 is used, the chip 46 contains the mixer 37, audio amplifier 38, the voltage controlled oscillator 35 and the super low frequency oscillator 36 which are not shown separately in FIG. 4.

Referring to FIGS. 3 and 4, the operation of device 10 shall now be described. When one of the function select switches 25 (S1–S4) is depressed, the function select circuitry 45 feeds a signal to the mixer 37. This signal selects one or a combination of the signals from the tone generators, (the VCO 35 and/or SLF 36) and mixes them together in a logical AND fashion or uses one of these signals to modulate the other. The resulting signal is then fed to the audio amplifier 38 where it is amplified and used to drive the audio output transducer or sound producing means (speaker) 22 so it can be heard by the user. The output from the audio amp 38 is also used to drive the LED circuits 40 an hence the LEDs 19 in unison with the sound so that the light emitted from each LED 19 flashes on and off or wavers in intensity in synch with the sound output of the audio amp 38.

It is of course understood that the above described circuitry is intended to demonstrate in general, the theory of operation and the electronic circuits used to create the effects of the present invention. There are other ways to combine electronic circuits to accomlish the desired result and they are intended to be included with the spirit of the present invention which is not limited to the specific circuitry shown.

One such alternative involves the use of a single integrated circuit chip 46 such as Texas Instruments SN 76495N. Such a chip is useful because it has integrated into its circuits a VCO, an SLF, digitally selectable mixer inputs, and an audio amplifier. Even though such a chip requires the use of external discrete components therewith such as capacitors (C2, C3) and resistors (R7, R8), it substantially reduces the overal complexity and bulk of the finished device.

While a variety of effects or functions can be designated for device 10, the present disclosure presents four as representative, namely, "Disintegrate", "Vaporize", "Pulverize", and "Stun". Of course, other verbs which aptly describe the means for eliminating the fantasy foe can be used if desired without departing from the basic concept hereof. Each function has its own switch and circuitry.

Depressing any one of the four function selection switches 25 causes power to be applied to the integrated circuit chip 46 to activate the chip and the appropriate light and sound effect.

Referring to FIG. 4, the VCO 35, and SLF 36, a mixer 37 and an audio amplifier 38 are included in chip 46 and are not separately identified. The VCO has its center frequency primarily determined by the external components capacitor C3 and resistor R8. (Note that pins 10 and 11 have internal 9K series resistors for current protection. These internal series resistors add to the value of resistance that determines these oscillators-'operating frequencies.) The SLF has its operating frequency primarily determined by capacitor C2 and resistor R7. The SLF produces two output voltage signals:

(1) a sawtooth or triangular wave which is used to modulate the frequency of the VCO which creates a warbling phasor sound, and (2) a 50% duty square wave which is mixed in a logical AND fashion with the output of the VCO which creates a pulsing phasor sound. The mixer combines the output signals from the two oscillators and outputs the resulting signal to the IC's audio amplifier where it is output to the speaker 22. The ouptut from the audio amp is also used to drive the LED driver circuit 40 so that the LEDs pulse or waver with the phasor sounds.

When no switches are depressed, no power will be applied to any of the circuits. The circuits are inhibited. Depressing switch S1 applies power to the chip by forward biasing diode D8 which is connected to Vcc pin 6. S1 also supplies power to the light emitting diode (LED) driver circuit 40 which consists of LED4, transistor Q6, and resistor R6. Depressing S1 shorts pins 14 and 15 of the mixer select logic circuit to ground providing a 0 0 (low, low) logic signal to this portion of the mixers input. (Any logic pin left open provides a logic 0 to that input. Pin 16 of the selection logic is left open and provides a constant 0 logic signal to that part of the mixers 37 input.) The binary logic truth table for the mixer 37 select inputs shown below, shows that a 000 logic select input signal selects the voltage controlled oscillator only.

TABLE I

| FUNCTION SELECT LOGIC | |
|---|---|
| 000 | VCO |
| 001 | NOT USED |
| 010 | NOT USED |
| 011 | SLF VCO |
| 100 | NOT USED |
| 101 | NOT USED |
| 110 | NOT USED |
| 111 | INHIBIT |

Pin 13 is also a control pin which is left open to provide a constant low to that pin. Pin 13, when low, allows the triangular wave from the SLF to modulate the frequency of the VCO. This causes the frequency of the VCO to increase and decrease in a warbling fashion which creates the phasor sound effect. The 000 logic input signal applied to the mixer logic pins 14 and 15 passes this warbling VCO signal to the audio output amplifier where it is amplified and output through pin 7 the audio output pin. Capacitor C4 is used to decouple the output signal from the chip to the output transducer or speaker 22 so that it can be heard. The output transducer circuit consists of capacitor C4 and the audio speaker. Output transducer is an 8 ohm audio speaker. However, if a piseoelectric speaker is desired, a 10 ohm resistor will be placed in parallel with speaker 22. A small portion of the output from pin 7 is picked off and used to drive the LED drive circuit 40 which consists of LED4, resistor R6, and transistor Q6. Power is provided to this circuit by forward biasing the light emitting diode (D4). When S1 is depressed, part of the audio output signal is applied to the base of transistor Q6 through resistor R6 causing LED4 to waver or warble with the output sound effect.

When switch S2 is depressed, power is applied to the chip by forward biasing diode D7 which is connected to Vcc pin 6. S2 also provides power for the LED driver circuit 40 which consists of LED3, transistor Q5 and resistor R5. Once power is applied to the chip, 5 volts from the 5 volt regulator output pin 4 is applied to resistor R9 which holds pins 14 and 15 of the mixer input logic select circuitry high. Pin 16 remains open and therefore continues to provide this input with a logic 0. As can be seen from the truth table shown above, the logic signal 011, which is provided by pressing S2, send the 50% duty cycle squarewave from the SLF and the warbling phasor gun sound from the VCO to the mixer where it is mixed in a logical AND fashion to create a pulsing phasor gun sound effect. Note that pin 13 is open and remains low which allows the triangle wave from the SLF to modulate the frequency of the VCO. Again the mixer output is transferred to the audio amplifier amp, amplified and output via pin 7 where it is decoupled by capacitor C4 and used to drive the audio speaker 22 and the LED driver circuit 40 where it pulses LED3 on and off in unison with the audio output. Depressing S2 forward biases LED3 providing power to the LED driver circuit 40. By feeding a portion of the audio output signal to the base of transistor Q5 through resistor R5 causes Q5 to turn on and off like a switch in unison with the input signal and providing a current path to ground allowing LED3 to flash off and on, too, with the input signal.

S3 and S4 work in essentially the same way as S1 and S2 in that they provide logic select input circuit with the same digital select logic signal. That is, S3 supplies the logic inputs with 000 logic signals as does S1, and S4 supplies the logic inputs with 011 logic signal as S2 does. The only difference in the S3 and S4 works is that depressing these switches activates transistor Q2 through resistor R2. Activating this transistor provides a path to ground effectively shorting out resistor R7. Shorting out R7 changes the resistance that helps to determine the operating frequency of the SLF. Shorting out R7 does not change the pitch or tone of the sounds produced, but instead changes the rate at which the light and sound effects pulse and waver. Depressing switch S3 activates transistor Q1 through resistor R1 by forwarding biasing diode D2. This shorts out resistor R9 forcing pins 14 and 15 of the mixer select logic low or 00. Pin 16 is open and low or 0 providing 000 logic signal which selects the VCO only. The only difference in depressing S3 over S1 is that depressing S3 activates transistor Q2 through resistor R2 by forward biasing diode D3. Activating Q2 places pin 11 at ground by shorting out resistor R7. Shorting out R7 changes the resistance that helps determine the operating frequency of the SLF and therefore changes the rate at which the VCO warbles or wavers. In this case, the phasor's warbling sound is slowed down. Finally, depressing S4 activates transistor Q2 through resistor R2 by forward biasing diode D4. As explained earlier, this shorts out resistor R7 changing the operating frequency of the SLF. In this case, Q1 is not activated so pins 14 and 15 are held high by the voltage applied to resistor R9 from the voltage regulator output pin 4. The 011 logic signal at the input of the mixer logic select causes the mixer to combine the 50% dutycycle squarewave from the SLF and the warbling output from the VCO in a logical AND fashion as does depressing S2. The difference here, again, is that R7 has been shorted out and slows down the rate at which the VCO warbles and the rate at which the phasor sound effect is pulsed.

Power is applied to the circuits in the same way when switches S3 and S4 are depressed as when S1 and S2 are depressed. S3 forward biases diode D6, and S4 forward biases diode D5. The LED driver circuits 40 consisting of LED2, transistor Q4, resistor R4 and LED1, transistor Q3, resistor R3 work in exactly the same way as the other LED driver circuits 40.

As is known, other combinations of digital select signals are availability to the chip used herein but as shown in the truth table, they are not used.

It is also possible to place a second LED in series with LED1, LED2, LED3, LED4 and to locate them on the wrist control panel with switches S1–S4 within the scope hereof.

The device 10 is used in the following manner. The user assures that an operable battery 31 is disposed in housing or pouch 29 and properly connected (not shown). The user then inserts his hand and arm into gauntlet 11 through opening 12 until the user's thumb protrudes through thumb opening 15 and his/her fingers pass through finger openings 16 thereby placing the user's hand and arm operatively within gauntlet 11.

The user selects the particular function with which he desires to zap his adversary, aims the device at his foe so that the beams of light produced by light source 19 and collimated by collimating means 20 high the target which in the dark can be as far as twenty feet away. The user then pushes switch 25, associated with a preselected function to activate a particular light source 19, such as a red, yellow or green Light Emitting Diode (LED) and causes a particular composite sound to be emitted form sound producing means 22, such as a pizoelectric speaker. Each function will produce a unique light source 19 and a unique sound effect.

When the user simultaneously pushes more than one switch 25, the light source 19 of each function will be activated but only one composite sound will be produced. Thus the activation of more than one switch will activate all the discrete light source associated with each function but will produce a single sound from sound producing means 22 which is determined by the particular logical hierarchy activated by the combination activated.

The body portion or gauntlet 11 of device 10 may be constructed from any pliable fabric or plastic using conventional sewing or molding techniques. In a preferred embodiment, gauntlet 11 will be injection molded which will allow the light and electronic components to be embedded within the body portion and avoid abrasions which could result from sharp protruding parts.

From the foregoing it is readily apparent that the device herein described and illustrated achieved all of the foregoing objectives in a remarkably unexpected manner. It is of course understood that such modifications, alterations and adaptations, as may readily occur to the artisan skilled in the field to which this invention pertains when confronted by this disclosure are intended within the spirit of the present invention which is limited only by the scope of the claims appended hereto.

Accordingly, what is claimed is:

1. An amusement device for use on a human arm comprising: a body member having an arm surrounding portion, a hand surrounding portion and a mouth portion, said hand surrounding portion having a palm surface and a back surface, said mouth portion providing an opening for introducing the user's hand into said hand surrounding portion and the user's arm into said arm surrounding portion; effect emitting means secured to said body member on said back surface of said hand surrounding portion, said effect emitting means comprising a light source, light collimating means operatively disposed in front of said light source to collimate the light emitted therefrom and direct the light away from said body portion, sound producing means, and housing means enclosing said effect emitting means; a control assembly secured to said arm surrounding portion adjacent said hand surrounding portion, said control assembly having a housing member and switching means disposed within said housing member; power means attached to said arm surrounding portion; mixer means operatively interposed between said control assembly and said effect emitting means and electrical connector means operatively connecting said power means to said effect emitting means through said control assembly and said mixer to selectively activate said sound producing means and said light source to create one or more of a variety of interrelated laser and phasor simulating sights and sounds therewith.

2. A device according to claim 1, wherein said switching means comprises a plurality of switches.

3. A device according to claim 2 in which said light source comprises a plurality of light emitting diodes.

4. A device according to claim 1 in which said light source comprises a plurality of light emitting diodes.

5. A device according to claim 4 in which each of said LEDs is connected to a different one of said switching means.

6. A device according to claim 5 in which the activation of a plurality of said switching means will cause a plurality of said LEDs to function while said mixer will permit and select only one particular sound from said sound producing means; said selected sound being determined by a particular logical hierarchy activated by the particular said switching means activated.

7. An amusement device comprising: a body member having a mouth, an arm surrounding portion in communication with said mouth, a hand surrounding portion, said hand surrounding portion being integrally formed with said arm surrouding portion remote from said mouth and having openings defined therethrough; effect emitting means operatively disposed on said hand surrounding portion on the back surface thereof including housing means, light source operatively disposed within said housing means, and collimating means operatively secured within said housing means in front of said light source to collimate the rays of light produced thereby; sound producing means and control means operatively secured to the exterior of said arm surrounding portion; portable power supply means operatively disposed on said arm surrounding portion; and power connection means having a mixer operatively associated therewith and interconnecting said portable power supply means to said control means and hence to said light source aand said sound producing means so as to simultaneously activate said sound producing means and said light souce in response to the selective activation and deactivation of said control means to create laser and phasor simulating sights and sounds therewith.

8. A device according to claim 7 in which said control means comprises a housing, switching means disposed within said housing, a function-select circuit operatively connected to said switching means; said mixer operatively interposed between said function-select circuit and said effect emitting means; said power connection means operatively connecting said portable power supply means to said effect emitting means through said control means.

9. A device according to claim 8 in which said switching means comprises a plurality of switches.

10. A device according to claim 9 in which said light source comprises a plurality of light emitting diodes.

11. A device according to claim 10 in which each of said LEDs is connected to a different one of said switching means.

12. A device according to claim 11 in which the activation of a plurality of said switches will cause a plurality of said LEDs to function while said mixer will permit and select only one particular sound from said sound producing means; said selected sound being determined by a particular logical hierarchy activated by the particular combination of said switching means activated.

13. A device according to claim 7 in which said light source comprises a plurality of light emitting diodes.

* * * * *